US009533844B2

(12) United States Patent
Doyo

(10) Patent No.: US 9,533,844 B2
(45) Date of Patent: Jan. 3, 2017

(54) PAPER FEEDING DEVICE AND IMAGE FORMING APPARATUS

(71) Applicant: KYOCERA Document Solutions Inc., Osaka (JP)

(72) Inventor: Hideaki Doyo, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 15/086,599

(22) Filed: Mar. 31, 2016

(65) Prior Publication Data

US 2016/0297630 A1 Oct. 13, 2016

(30) Foreign Application Priority Data

Apr. 7, 2015 (JP) ..... 2015-078306

(51) Int. Cl.

| | |
|---|---|
| ***B65H 1/14*** | (2006.01) |
| ***B65H 1/26*** | (2006.01) |
| ***B65H 7/00*** | (2006.01) |
| ***B65H 1/08*** | (2006.01) |
| ***B65H 7/02*** | (2006.01) |
| ***B65H 1/18*** | (2006.01) |

(52) U.S. Cl.

CPC *B65H 1/14* (2013.01); *B65H 1/08* (2013.01); *B65H 1/18* (2013.01); *B65H 1/266* (2013.01); *B65H 7/00* (2013.01); *B65H 7/02* (2013.01); *B65H 2403/41* (2013.01); *B65H 2405/1116* (2013.01); *B65H 2405/1117* (2013.01); *B65H 2405/35* (2013.01)

(58) Field of Classification Search

CPC ..... B65H 1/08; B65H 1/14; B65H 1/18; B65H 2403/41; B65H 2405/1116; B65H 2405/1117; B65H 2405/35; B65H 7/00; B65H 7/02

USPC ... 271/22, 24, 30.1, 127, 128, 130, 152, 155

See application file for complete search history.

(56) References Cited

U.S. PATENT DOCUMENTS

| | | | | |
|---|---|---|---|---|
| 3,724,839 A * | 4/1973 | Suzuki | B65H 1/14 271/117 |
| 2003/0053834 A1* | 3/2003 | Suzuki | G03G 15/6514 399/392 |
| 2012/0161391 A1* | 6/2012 | Kawamura | B65H 1/266 271/275 |

FOREIGN PATENT DOCUMENTS

| | | |
|---|---|---|
| JP | 04277138 A * | 10/1992 |
| JP | 2003-112830 | 4/2003 |

* cited by examiner

*Primary Examiner* — David H Bollinger

(74) *Attorney, Agent, or Firm* — Wenderoth, Lind & Ponack, L.L.P.

(57) ABSTRACT

A gear engagement mechanism of a life device includes a lifting member interlocking with a lifting tray to linearly move in a vertical direction, and a gear train having a pinion engaged with the rack to transmit a rotary motion to the rack and transmitting the rotation torque of a lift motor M to the pinion. When the lifting member has over-run an upper limit stop position and a lower limit stop position, engagement of the pinion and the rack is released.

4 Claims, 11 Drawing Sheets

PAPER FEEDING DEVICE AND IMAGE FORMING APPARATUS

CROSS-REFERENCE TO RELATED APPLICATION

This application is based upon and claims the benefit of priority from Japanese Patent Application No. 2015-078306 filed on Apr. 7, 2015, the entire contents of which are incorporated herein by reference.

BACKGROUND

The technology of the present disclosure relates to an image forming apparatus such as a copy machine and a printer and a paper feeding device constituting a part thereof.

In a paper feeding device, one end of a lifting tray is connected to a paper feeding tray, on which papers to be fed are placed, so as to be rotatable. Furthermore, in the paper feeding device, a shaft is arranged at a lower side of the lifting tray, and one end of a lift plate is integrally and rotatably connected to the shaft and abuts and supports the other end side of the lifting tray side from below at the other end of the lift plate. Furthermore, the shaft is rotated by the start of a lift motor to rise the lift plate, so that the lifting tray is lifted up and thus the papers placed on the paper feeding tray are sent from the paper feeding tray by a pickup roller one by one.

SUMMARY

A paper feeding device according to one aspect of the present disclosure includes a paper feeding tray, a lifting tray, and a lift device. On the aforementioned paper feeding tray, a paper to be fed is placed. The aforementioned lifting tray has one end connected to the aforementioned paper feeding tray so as to be rotatable and holds the paper from below. The aforementioned lift device is provided corresponding to the other end side of the aforementioned lifting tray. Furthermore, the lift device lifts up and down the aforementioned lifting tray via a gear engagement mechanism driven by rotation torque of a lift motor.

The aforementioned gear engagement mechanism includes a lifting member and a gear train. The aforementioned lifting member has a rack. Furthermore, the lifting member interlocks with the aforementioned lifting tray to linearly move in a vertical direction. The aforementioned gear train has a pinion engaged with the aforementioned rack to transmit a rotary motion to the rack. Furthermore, the gear train transmits the rotation torque of the aforementioned lift motor to the pinion. When the aforementioned lifting member has over-run an upper limit stop position and a lower limit stop position, engagement of the aforementioned pinion and the aforementioned rack is released.

An image forming apparatus according to another aspect of the present disclosure includes the aforementioned paper feeding device.

BRIEF DESCRIPTION OF THE DRAWINGS

FIG. 5 is viewed in a direction A.

DETAILED DESCRIPTION

Hereinafter, one example of an embodiment will be described in detail on the basis of the drawings. It is noted that the technology of the present disclosure is not limited to the following embodiment.

Figure 1:
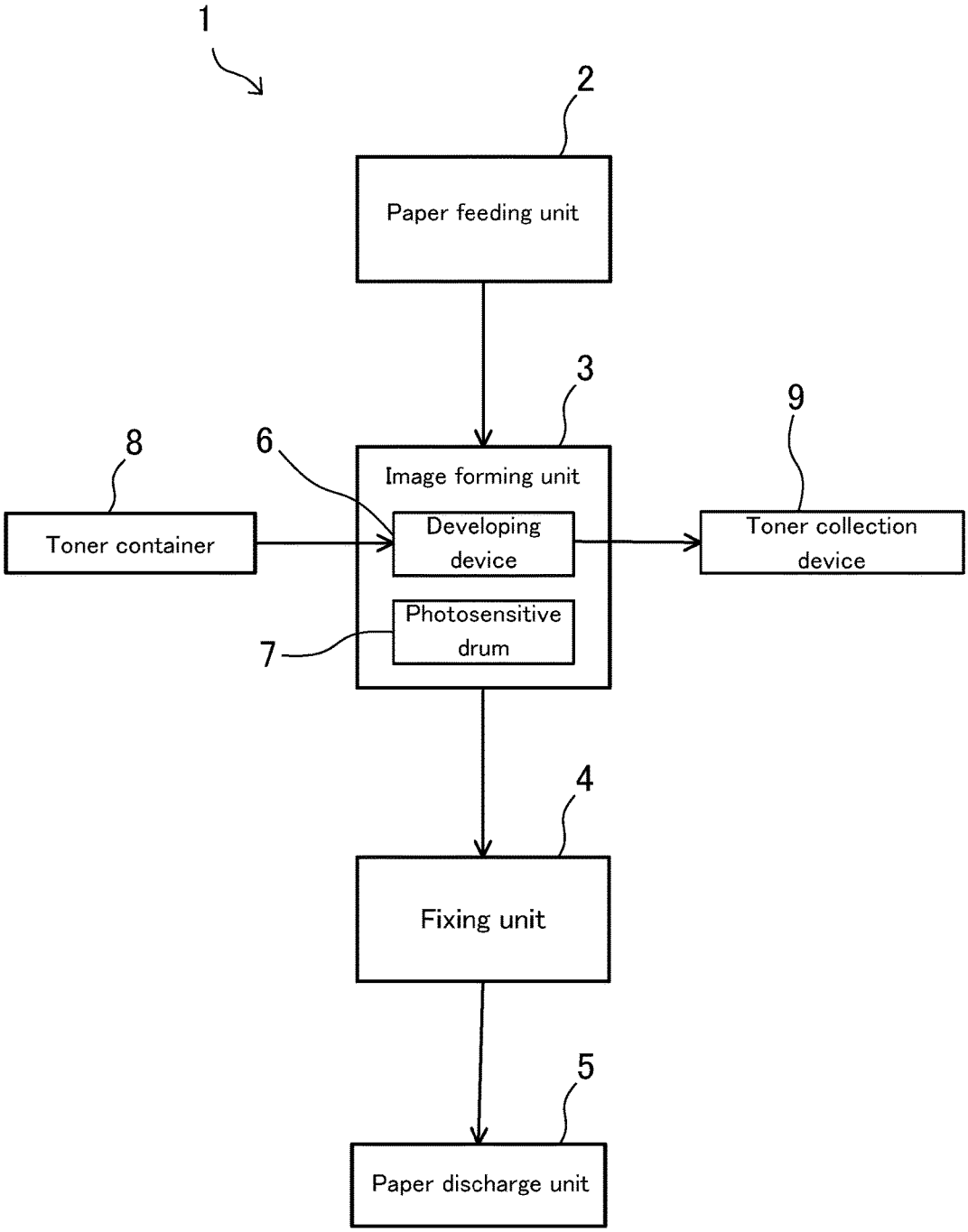
FIG. 1 is a block diagram illustrating a configuration of an image forming apparatus.

FIG. 1 illustrates an image forming apparatus 1 such as a laser printer and a multifunctional peripheral, wherein the image forming apparatus 1 is configured to form an image on a paper on the basis of image data transmitted from a terminal and the like (not illustrated) while conveying the paper. The image forming apparatus 1 includes a paper feeding unit 2, an image forming unit 3, a fixing unit 4, and a paper discharge unit 5.

The paper feeding unit 2 is a cassette paper feeding unit or a manual paper feeding tray that supplies a paper to the image forming unit 3. The image forming unit 3 includes a developing device 6, a photosensitive drum 7 and the like. In the image forming unit 3, an electrostatic latent image is formed on the photosensitive drum 7 by an optical scanning device (not illustrated) and is developed as a tone image by the developing device 6. The toner image is transferred to a paper supplied from the paper feeding unit 2. The fixing unit 4 includes a fixing roller and a pressure roller (not illustrated) and fixes the toner image, which has been transferred to the paper in the image forming unit 3, to the paper. In this way, an image is formed on the paper. The paper with the formed image is discharged to the paper discharge unit 5 from the fixing unit 4.

Moreover, the image forming apparatus 1 includes a toner container 8 and a toner collection device 9. The toner container 8 receives toner as a developer to be supplied to the developing device 6. The toner collection device 9 collects toner remaining on the photosensitive drum 7.

Figure 2:
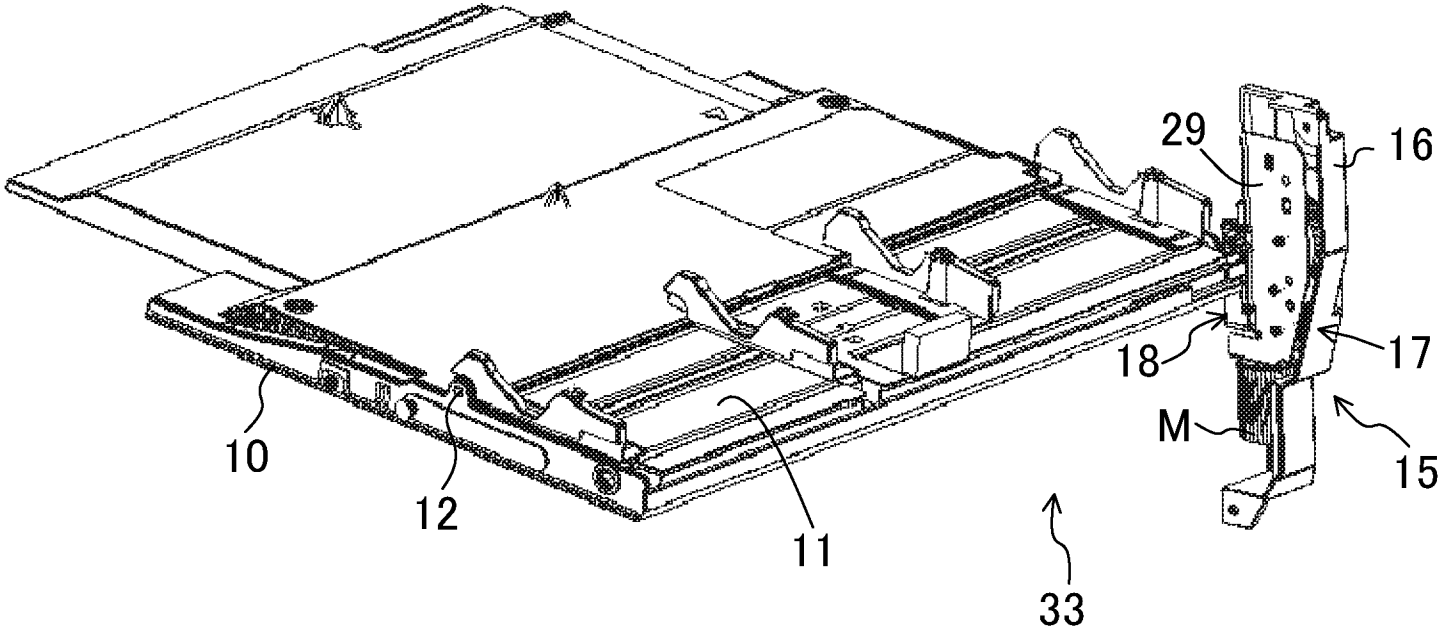
FIG. 2 is a perspective view of a paper feeding device before a lifting tray is risen.
Figure 3:
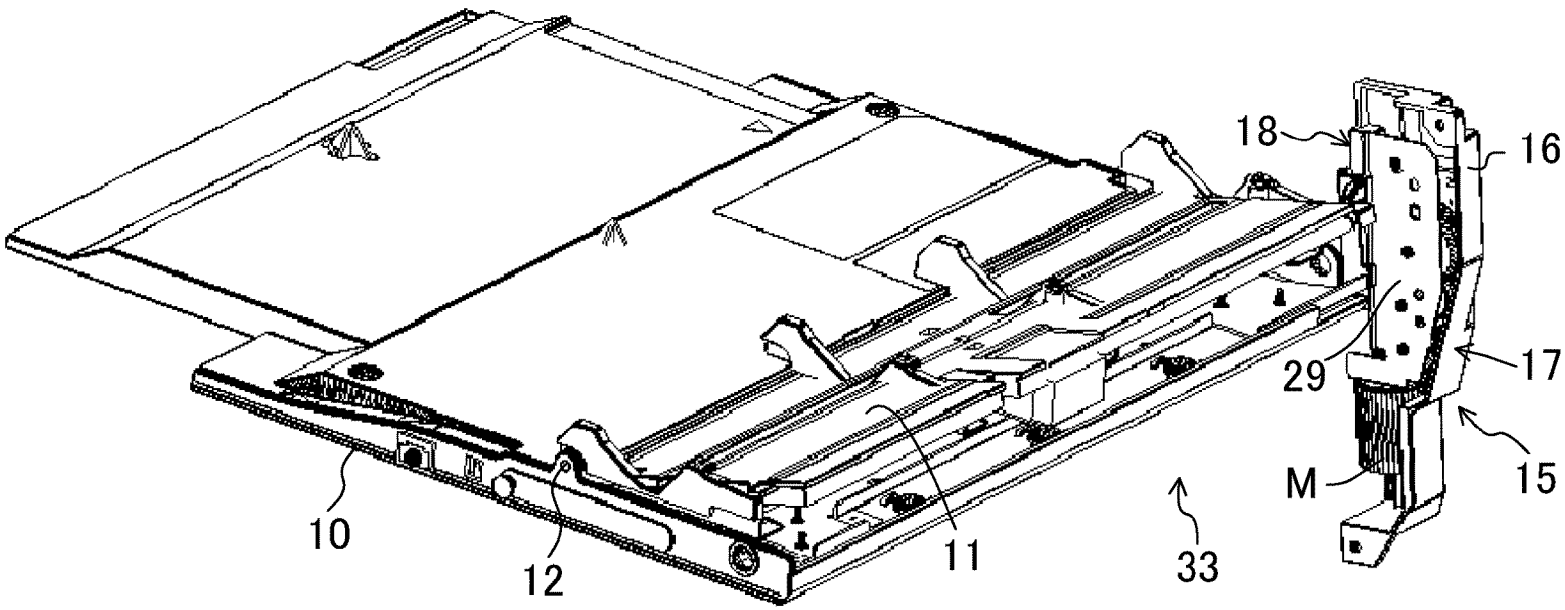
FIG. 3 is a perspective view of a paper feeding device after a lifting tray is risen.

FIG. 2 and FIG. 3 illustrate a paper feeding device 33 constituting the paper feeding unit 2, wherein the paper feeding device 33 includes a manual paper feeding tray 10 on which papers (not illustrated) to be fed are placed.

On the paper feeding tray 10, one end of a lifting tray 11 is connected to be rotatable by a shaft 12. The lifting tray 11 holds a part of the paper from below. The other end of the lifting tray 11, for example, is supported from below by an urging part 34.

At an approximate center portion of an upper side of the other end side (the right end side of FIG. 2 and FIG. 3) of the lifting tray 11, a pick-up roller (not illustrated) is arranged. A paper positioned on the uppermost surface of the lifting tray 11 is taken out by a rotating operation of the pick-up roller and is sent to the photosensitive drum 7 side.

Figure 4:
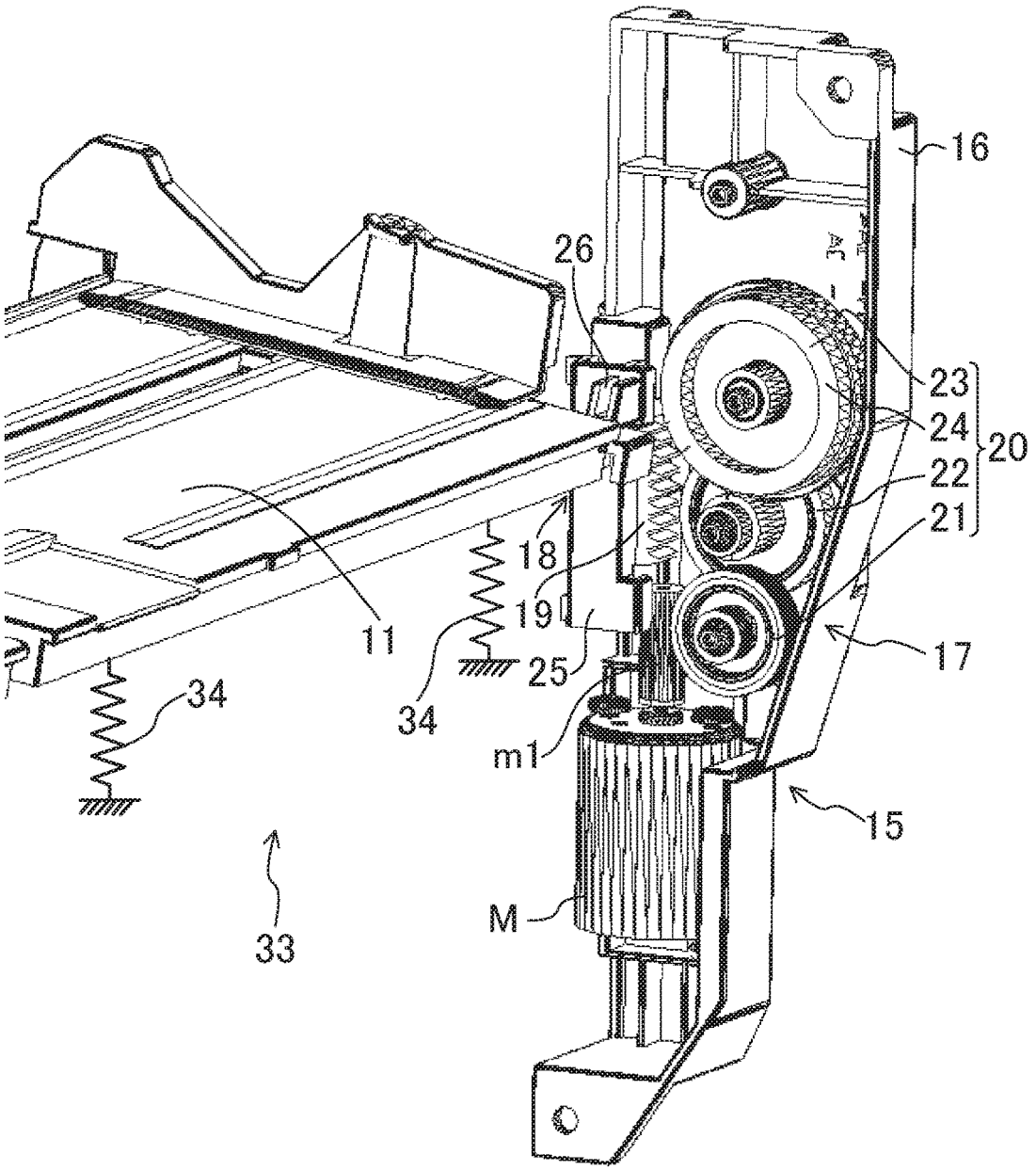
FIG. 4 is an enlarged perspective view of a lifting tray before being risen and a lift device.

A lift device 15 is provided corresponding to the other end side (the right end side of FIG. 2 and FIG. 3) of the lifting tray 11. As illustrated in FIG. 4, the lift device 15 includes a lift motor M arranged at a lower end side of a receiving case 16 and a gear engagement mechanism 17 arranged above the lift motor M. Furthermore, the lift device 15 lifts up and down the lifting tray 11 via the gear engagement mechanism 17 driven by rotation torque of the lift motor M.

In detail, the gear engagement mechanism 17 includes a lifting member 18. The lifting member 18 is provided with a rack 19 having a plurality of tooth parts 19*a* (see FIG. 7) vertically arranged in a straight line. At the lateral side of the rack 19, a gear train 20 is arranged. The gear train 20 includes a first gear 21, a second gear 22, and a third gear 23 engaged with one another. The first gear 21, the second gear 22, and the third gear 23 are sequentially arranged from below and a pinion 24 engaged with the tooth parts 19*a* of the rack 19 is coaxially mounted with the third gear 23.

At an output shaft of the lift motor M, a worm gear ml engaged with the first gear 21 is fixed. The rotation torque of the lift motor M is transmitted to the rack 19 via the worm gear ml, the first gear 21, the a second gear 22, the third gear 23, and the pinion 24. Furthermore, the rack 19 linearly moves the lifting member 18 up and down.

Figure 7:
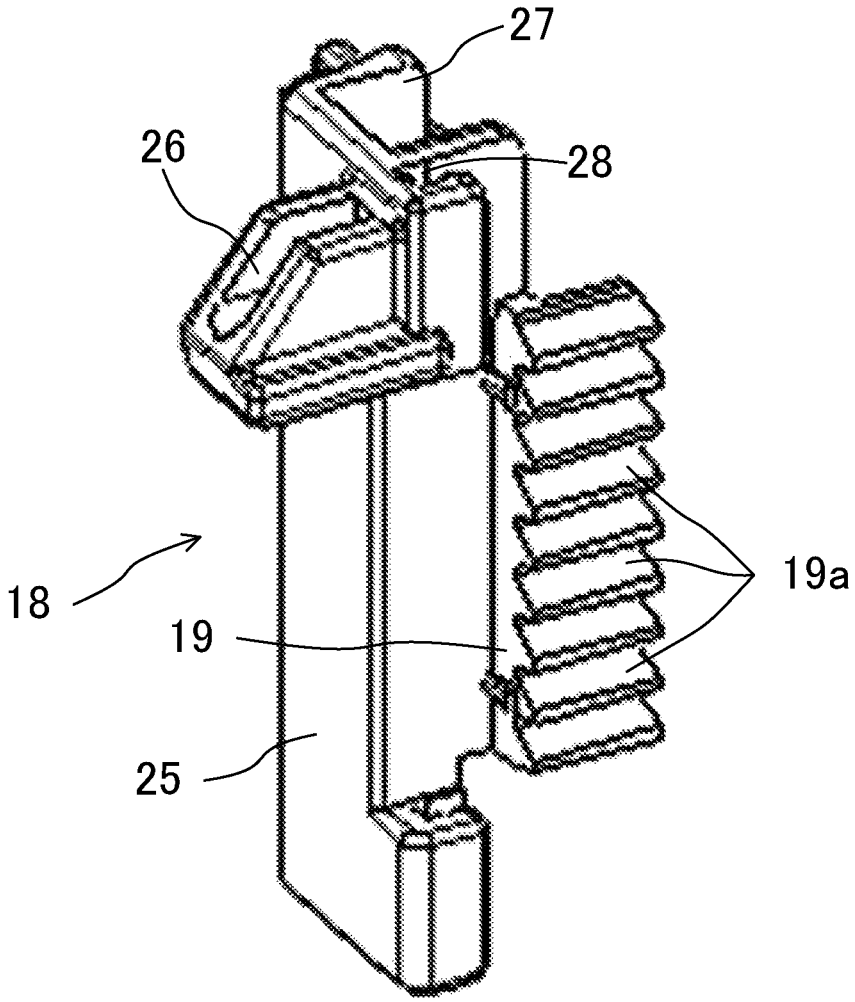
FIG. 7 is a perspective view of a lifting member.
Figure 8:
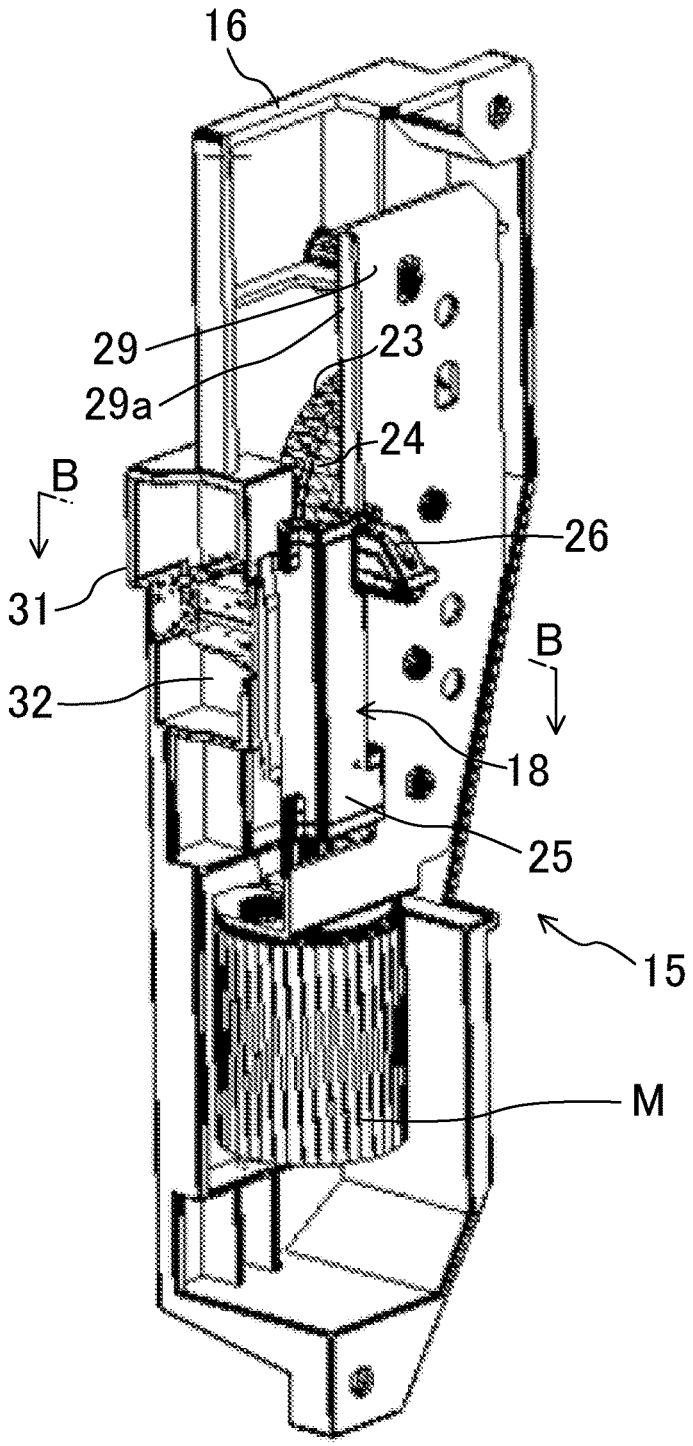
FIG. 8 is a perspective view when

As illustrated in FIG. 7, the lifting member 18 includes a slider 25. From an upper end of one surface of the slider 25, an abutting piece 26 protrudes. In a surface of the slider 25 opposite to the abutting piece 26, a large groove 27 and a small groove part 28 vertically extending are provided in parallel to each other, and at a lateral side of the small groove part 28, the rack 19 is provided in parallel to the small groove part 28.

As illustrated in FIG. 5, FIG. 6, FIG. 8, and FIG. 9, the gear engagement mechanism 17 is covered by a cover plate 29 having a slide rail 29*a* vertically extending. The slide rail 29*a* is inserted into the small groove part 28 of the lifting member 18 so as to be vertically movable.

The abutting piece 26 of the lifting member 18 faces an upper surface of a right end portion of the lifting tray 11 in FIG. 4. Furthermore, the lifting tray 11 is pushed up by urging force of the urging part 34, so that the abutting piece 26 abuts the upper surface of the right end portion of the lifting tray 11 in FIG. 4 and thus the lifting member 18 operates so as to be integrally movable with the lifting tray 11. In this way, the rotation torque of the lift motor M is transmitted to the gear engagement mechanism 17, so that the lifting tray is lifted up and down.

Figure 5:
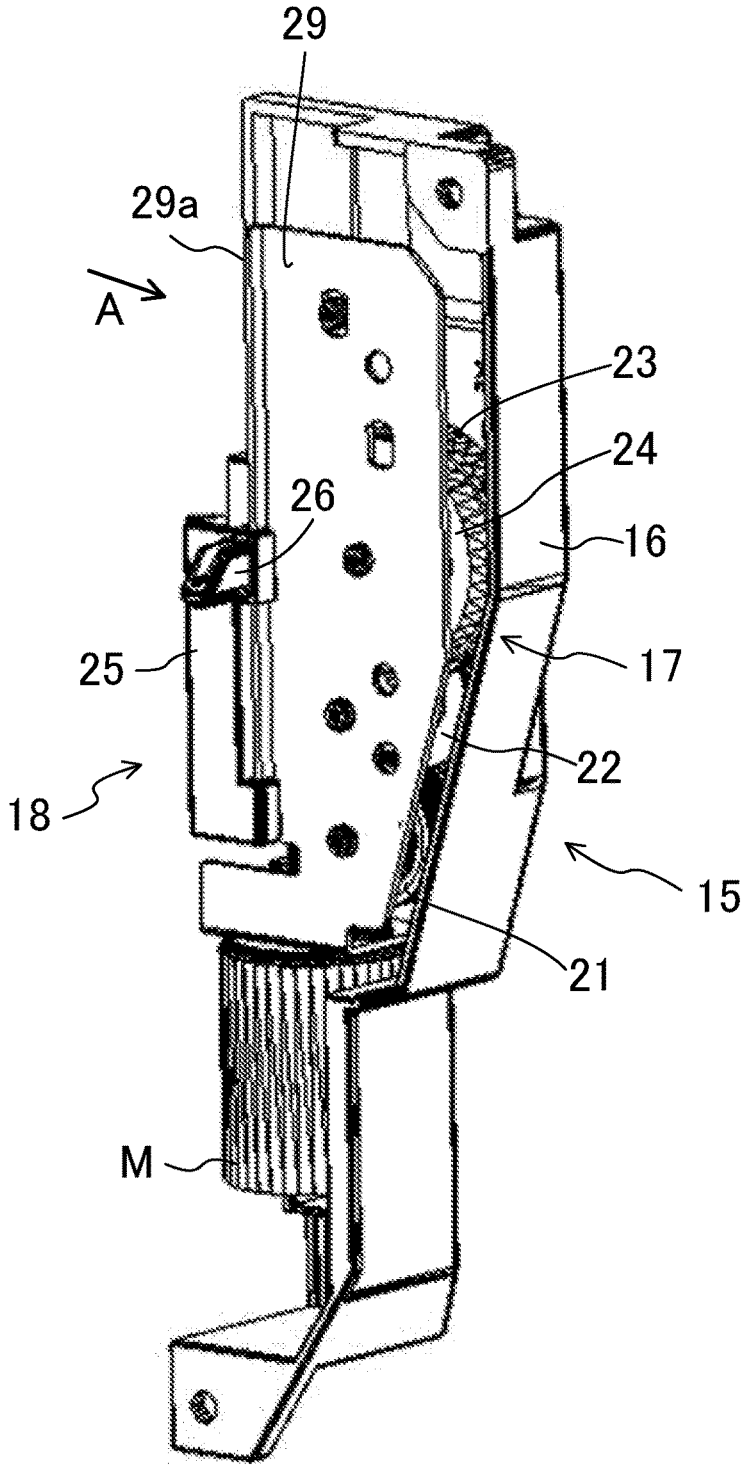
FIG. 5 is an enlarged perspective view of a lift device in the state in which a lifting member has been lowered.
Figure 6:
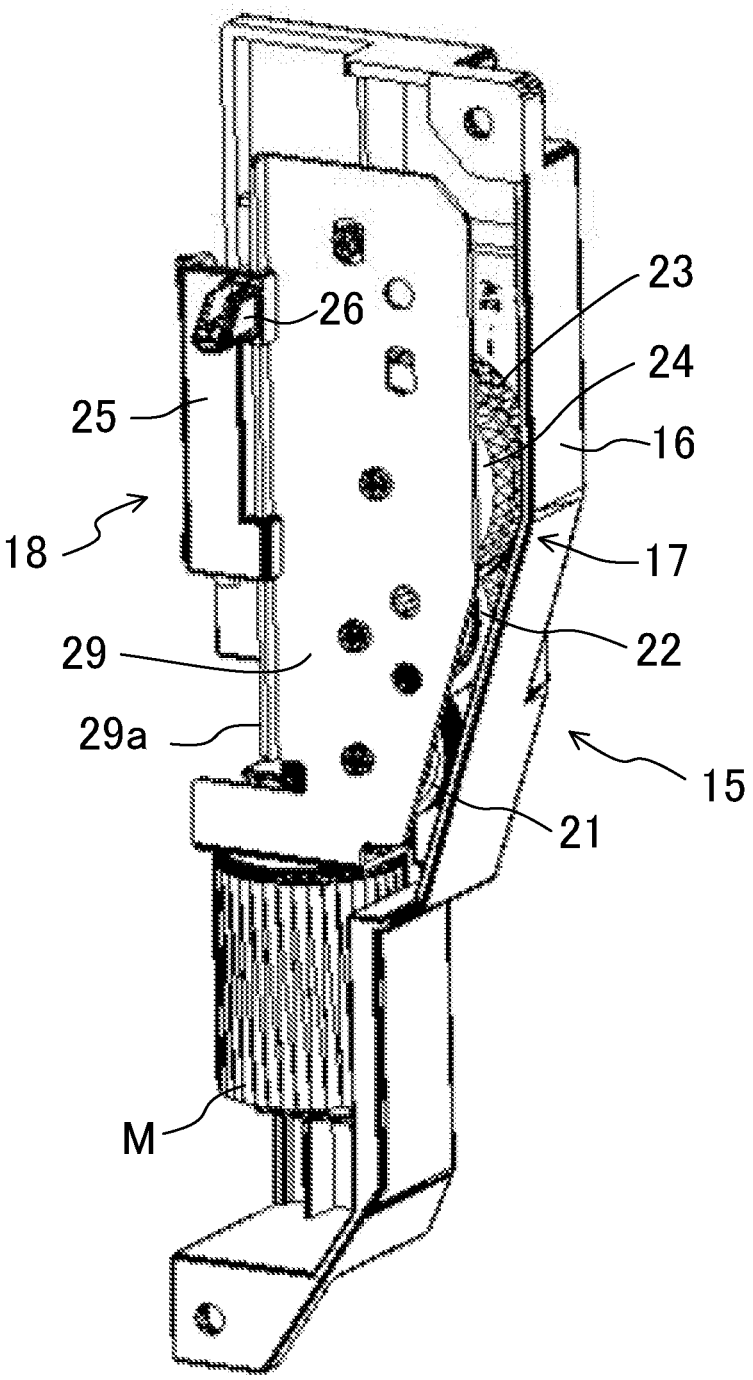
FIG. 6 is an enlarged perspective view of a lift device in the state in which a lifting member has risen.

In a paper feeding state, as illustrated in FIG. 3 and FIG. 6, the lifting tray 11 rises, so that an upper surface of a paper on the lifting tray 11 abuts the pick-up roller. On the other hand, in a non-paper feeding state, as illustrated in FIG. 2 and FIG. 5, the lifting tray 11 falls, so that a paper and the pick-up roller are separated from each other.

Figure 9:
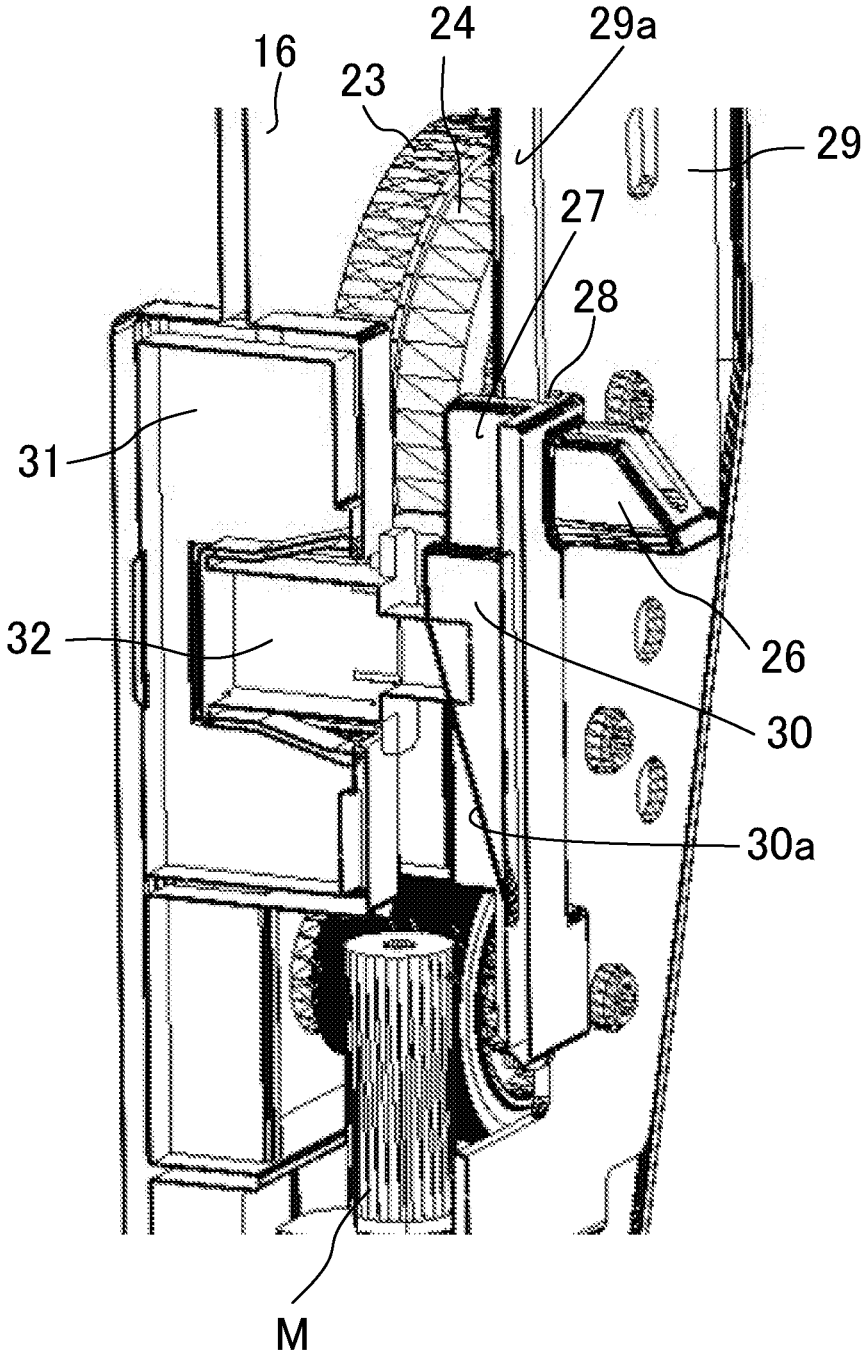
FIG. 9 is a perspective view taken along line B-B of FIG. 8.

From the large groove 27 of the lifting member 18, a pressing piece 30 as illustrated in FIG. 9 protrudes. At a protruding end of the pressing piece 30, an inclination part 30*a* inclined downwardly to the right side of FIG. 9 is formed.

On the other hand, at the receiving case 16 side, a switch mounting part 31 is formed corresponding to the lifting member 18. The switch mounting part 31 is provided with a push switch 32 as a detection part that detects the remaining amount of papers on the paper feeding tray 10 on the basis of a rising position of the lifting tray 11. The push switch 32 is mounted at a position corresponding to the large groove 27.

When the remaining amount of papers on the paper feeding tray 10 is 100%, the push switch 32 is pressed by an upper end of the pressing piece 30 and enters an OFF state. FIG. 9 illustrates the state in which the upper end of the pressing piece 30 has interfered with the push switch 32, and actually illustrates the state in which the push switch 32 has been pushed by the pressing piece 30 and sunk down. When the lifting member 18 rises with a reduction of the remaining amount of papers on the paper feeding tray 10, the pressing piece 30 is upwardly away from the push switch 32, so that the push switch 32 protrudes. Furthermore, when the remaining amount of papers, for example, is reduced to 30%, since the pressure by the pressing piece 30 is released, the push switch 32 is turned ON, so that an ON signal (a remaining amount detection signal) is inputted to a control unit (not illustrated). In this way, it is determined that the remaining amount of papers, for example, has been reduced to 30%. During this period, the lifting tray 11 is inclined with respect to the upper surface of the paper feeding tray 10 and rises to a raised posture of FIG. 3 from a horizontal posture of FIG. 2 in which it has laid along the upper surface of the paper feeding tray 10.

Figure 10A:
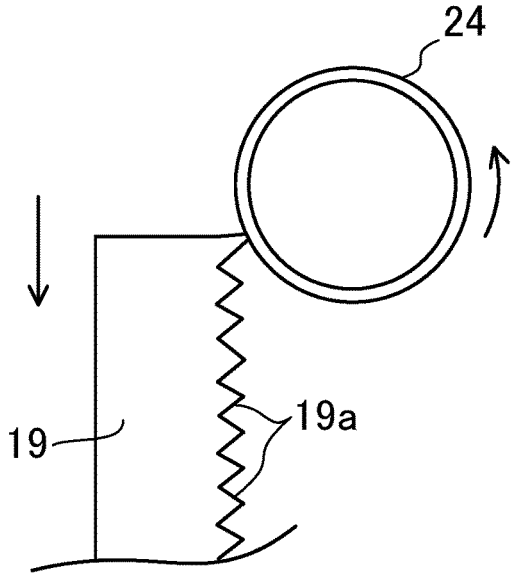
FIG. 10A is an explanation diagram illustrating a positional relation between a rack and a pinion when a lifting member has over-run a lower limit stop position.
Figure 10B:
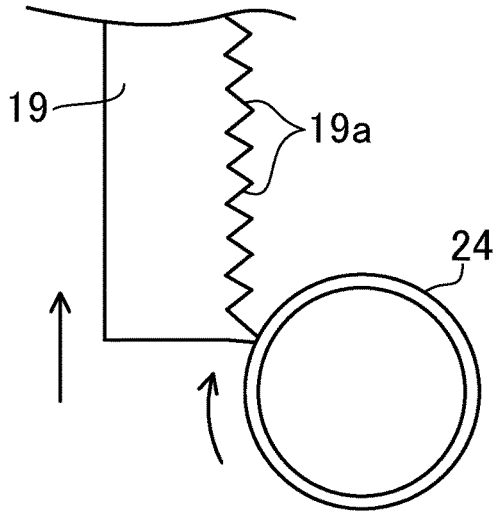
FIG. 10B is an explanation diagram illustrating a positional relation between a rack and a pinion when a lifting member has over-run an upper limit stop position.

At this time, for example, when an unexpected operation occurs in the lift motor M due to a trouble of a control system and the pinion 24 is not stopped and over-rotates clockwise in FIG. 10B, the lifting member 18 (the rack 19) over-runs an upper limit stop position with momentum and thus the pinion 24 is not engaged with the tooth parts 19*a* of the rack 19 (see FIG. 10B). In contrast, when the pinion 24 over-rotates counterclockwise in FIG. 10A, the lifting member 18 (the rack 19) over-runs a lower limit stop position and thus the pinion 24 is not also engaged with the tooth parts 19*a* of the rack 19 (see FIG. 10A).

As described above, in the present embodiment, in the lift device 15 that lifts the lifting tray 11 up and down, a rack and pinion has been employed as the gear engagement mechanism 17 that transmits the rotation torque of the lift motor M to the lifting tray 11. Furthermore, when the lifting member 18 has over-run the upper limit stop position and the lower limit stop position with momentum, the engagement of the pinion 24 and the rack 19 is released. Consequently, it is possible to prevent the rotation torque of the lift motor M from being transmitted to the rack 19, that is, the lifting member 18.

In this way, it is possible to achieve a small and simple configuration, and to prevent parts of the gear engagement mechanism 17 from being broken even when an unexpected operation has occurred in the lift motor M due to a trouble of a control system, for example. Consequently, it is possible to achieve the paper feeding device 33 with high reliability and thus to enhance the reliability of the image forming apparatus 1.

Figure 11:
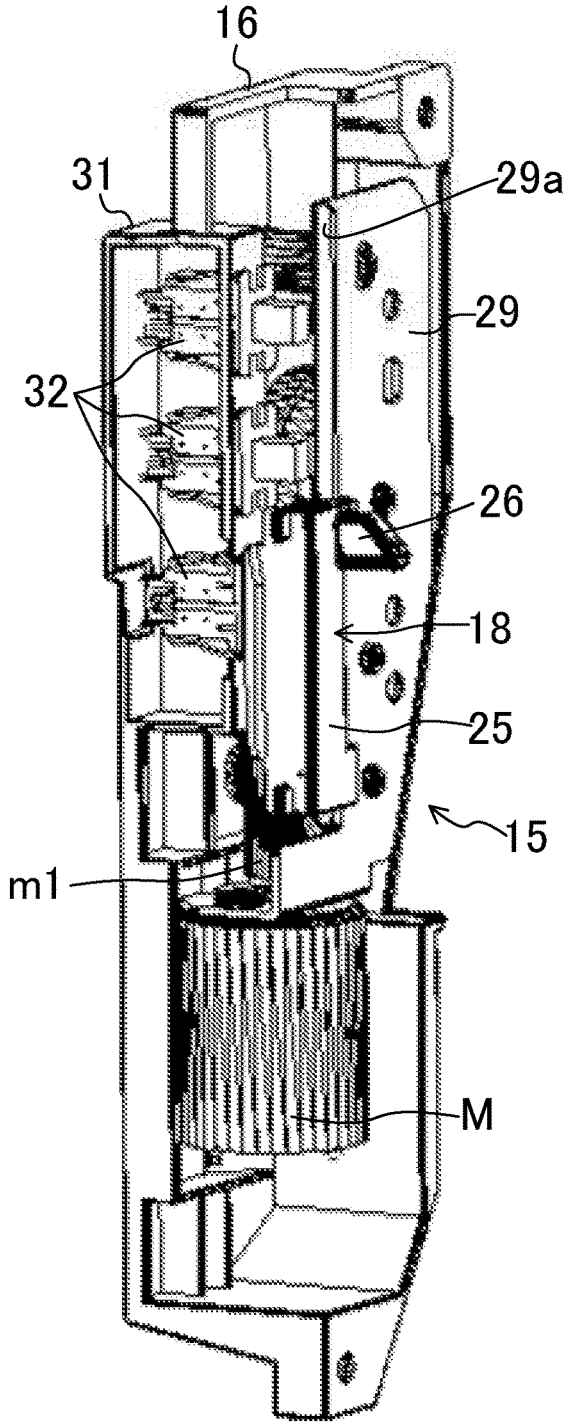
FIG. 11 is a diagram corresponding to FIG. 8 in another embodiment.

In addition, as illustrated in FIG. 11, when three push switches 32 are vertically provided spaced apart from one another, it is possible to minutely detect the number of papers remaining on the paper feeding tray 10. In this case, the front end of the pressing piece 30, for example, is configured to have a shape (not illustrated) curved in a protruding shape so as to be able to press each push switch 32. It is sufficient if the number of push switches 32 is increased and decreased according to necessity.

As described above, the present invention is useful for a paper feeding device and an image forming apparatus including the same.

What is claimed is:

1. A paper feeding device comprising:

a paper feeding tray on which paper to be fed is placed;

a lifting tray having one end connected to the paper feeding tray so as to be rotatable and holding the paper from below; and a lift device provided corresponding to another end side of the lifting tray and lifting up and down the lifting tray via a gear engagement mechanism driven by rotation torque of a lift motor, wherein the gear engagement mechanism comprises:

a lifting member having a rack and a slider interlocking with the lifting tray to linearly move in a vertical direction;

a gear train having a pinion engaged with the rack to transmit a rotary motion to the rack and transmit the rotation torque of the lift motor to the pinion;

a cover plate having a slide rail vertically extending and covering the gear train; and an urging part pushing up the lifting tray to an upper side, wherein an abutting piece abutting an upper surface of the lifting tray pushed up to the upper side by the urging part protrudes from one surface of the slider, a large groove and a small groove that extend vertically are formed on a surface opposite to an abutting piece side of the slider, the slider is configured so as to be vertically and linearly movable with the slide rail of the cover plate being inserted in the small groove, and when the lifting member has over-run an upper limit stop position or a lower limit stop position, engagement of the pinion and the rack is released.

2. The paper feeding device of claim 1, further comprising:

a plurality of detection parts that detect a remaining amount of paper on the paper feeding tray by a rising position of the lifting tray, wherein the detection parts are vertically provided while being spaced apart from each other.

3. The paper feeding device of claim 2, further comprising:

a receiving case that opens to one side to receive the gear train, wherein the cover plate is arranged to cover an open side of the receiving case, a pressing piece protrudes from the large groove of the lifting member, an inclination part inclined downwardly to a bottom wall part of the large groove is formed at a protruding end of the pressing piece, and the plurality of detection parts are a plurality of push switches that abut the inclination part by a vertical movement of the slider in a position corresponding to the large groove in the receiving case.

4. An image forming apparatus including the paper feeding device of claim 1.

* * * * *